US006837808B1

(12) United States Patent
Hatch

(10) Patent No.: US 6,837,808 B1
(45) Date of Patent: Jan. 4, 2005

(54) SPORT TRAINING DEVICE

(76) Inventor: Garland Hatch, 1235 E. Main St., Mesa, AZ (US) 85203

( * ) Notice: Subject to any disclaimer, the term of this patent is extended or adjusted under 35 U.S.C. 154(b) by 0 days.

(21) Appl. No.: 10/430,635

(22) Filed: May 5, 2003

(51) Int. Cl.[7] ..... A63B 69/40
(52) U.S. Cl. ..... 473/424
(58) Field of Search ..... 473/415–430, 473/331, 332, 333, 334, 335, 138, 139; 482/82, 81

(56) References Cited

U.S. PATENT DOCUMENTS

| | | | | | |
|---|---|---|---|---|---|
| 1,608,849 | A | | 11/1926 | Gilmour | |
| 2,194,674 | A | * | 3/1940 | Riddell | 473/597 |
| 2,253,075 | A | * | 8/1941 | Johnson | 482/82 |
| 2,307,905 | A | * | 1/1943 | Ament | 119/708 |
| 2,496,795 | A | | 2/1950 | Johnson | |
| 2,506,825 | A | | 5/1950 | Carlson | |
| 2,621,046 | A | | 12/1952 | Lamounette | |
| 2,765,170 | A | * | 10/1956 | Brown | 473/424 |
| 2,944,817 | A | * | 7/1960 | Stiller | 473/424 |
| 3,051,491 | A | * | 8/1962 | Cabot | 473/147 |
| 3,186,711 | A | * | 6/1965 | Morrow | 472/118 |
| 3,288,413 | A | | 11/1966 | Gregory | |
| 3,297,321 | A | * | 1/1967 | Morrow | 124/17 |
| 3,637,209 | A | * | 1/1972 | Raut | 473/424 |
| 3,731,925 | A | * | 5/1973 | Caldwell | 473/424 |
| 3,762,705 | A | | 10/1973 | Gonzalez | |
| 3,764,140 | A | | 10/1973 | Lotfy | |
| 3,767,198 | A | * | 10/1973 | Boyer | 473/423 |
| 3,790,171 | A | | 2/1974 | Anderson | |
| 3,804,409 | A | * | 4/1974 | Schachner | 473/423 |
| 3,893,669 | A | | 7/1975 | Myers | |
| 3,897,057 | A | | 7/1975 | Pennington | |
| 3,907,287 | A | * | 9/1975 | Fox et al. | 473/424 |
| 3,940,132 | A | | 2/1976 | Lopatto, III | |
| 3,942,794 | A | | 3/1976 | Gowins | |
| 3,953,029 | A | | 4/1976 | Boyd | |
| 4,093,225 | A | | 6/1978 | Oliver | |
| D250,609 | S | * | 12/1978 | Lang et al. | D21/672 |
| 4,173,340 | A | | 11/1979 | Kanno | |
| 4,293,125 | A | * | 10/1981 | Hinds | 482/82 |
| 4,350,338 | A | * | 9/1982 | May | 473/423 |
| 4,555,110 | A | | 11/1985 | Hai-Ping | |
| 4,660,835 | A | * | 4/1987 | Locurto | 473/147 |
| 4,887,814 | A | * | 12/1989 | Winter | 473/596 |
| 5,033,743 | A | * | 7/1991 | Wright | 473/613 |
| 5,165,682 | A | * | 11/1992 | McGuckin et al. | 473/424 |
| 5,203,558 | A | | 4/1993 | An | |
| 5,228,683 | A | | 7/1993 | Beimel | |
| 5,271,618 | A | | 12/1993 | Malwitz | |
| 5,282,615 | A | | 2/1994 | Green et al. | |
| 5,433,435 | A | * | 7/1995 | Bourie | 473/424 |
| 5,531,438 | A | | 7/1996 | Corley | |
| 6,142,889 | A | * | 11/2000 | Schaubach | 473/426 |

* cited by examiner

*Primary Examiner*—Nini F. Legesse
(74) *Attorney, Agent, or Firm*—Schmeiser, Olsen & Watts, LLP

(57) ABSTRACT

A sport training device for eye-hand coordination and reflexes having a target tethered to a handle is disclosed. Variations in the handle as well as the target create changes in the pathway of the target so as to enhance training. Various swivels between the handle and the target enable the target to be rotated in a relatively circular pathway without causing the tether to twist or tangle.

20 Claims, 6 Drawing Sheets

SPORT TRAINING DEVICE

TECHNICAL FIELD

This invention generally relates to a sports training device. More specifically, the device is a target on a tether which allows a trainer to swing the target so that the person being trained may attempt to hit the target with an implement such as a bat or racquet.

BACKGROUND AND SUMMARY OF THE INVENTION

Numerous sports require a high degree of hand-eye coordination. In particular, many sports utilize some tool or implement such as a baseball bat, tennis racquet, etc., in order to hit a moving object, often a ball of a particular size and material. Often in these sports, there is an opponent who is propelling the projectile toward the other player. In doing so, the projectile or ball may have a certain amount of spin or curve on it. For example, pitchers are much more effective if they utilize a variety of pitches such as curve balls, sliders, change ups and the like.

Accordingly, a person participating in one of these sports needs to develop not only good hand-eye coordination but excellent reflexes and judgement in adapting to certain quick or unexpected ball movements. Learning to anticipate those movements and respond quickly and accurately may be the difference between overall success or failure.

While many devices have been developed to project a target toward a user to develop reaction time and hand-eye coordination, cost and size are at times prohibitive. Also, these devices do not adequately provide the variation of ball movements necessary to train fully.

The subject invention is a sports training device which has a ball or other target tethered to a handle. The target, tethering arrangement and/or other features can enable the target to move in unique pathways, thus developing both hand-eye coordination and improving reaction time. To avoid twisting of the tether, one or more swivels may be used to account for and reduce the effect of the rotation of the target.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a training device having a target tethered to a handle.

Figure 1:
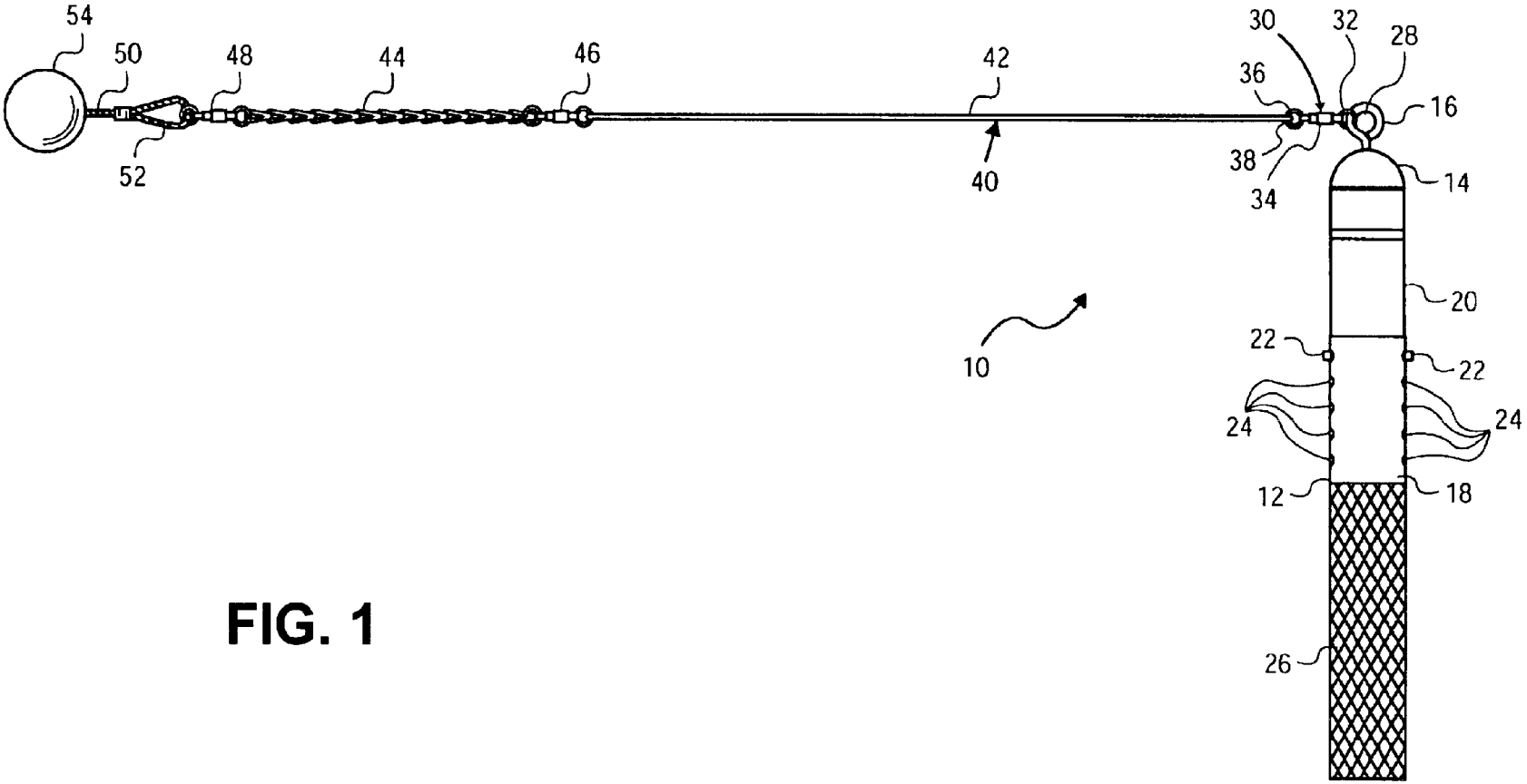
FIG. 1 is a side elevational view of the invention.

As shown in FIG. 1, there is a sport training device generally designated as 10. The device has a handle 12 which has a cap 14 and a tether connector 16.

In one embodiment the handle consists of an outer sleeve 18 and an inner sleeve 20. The inner sleeve has at least two opposing detents 22 which are biased outwardly so that the detents 22 may be compressed and the inner sleeve 20 slid within the outer sleeve 18 until the detents 22 are aligned with the desired holes 24 in the outer sleeve 18. Thus the handle has a telescoping feature which allows a user to select a desired length and which may also help to change the angle of the pathway of the target so as to present to the person seeking to hit the target different angles of incidence. The lower part of the outer sleeve 18 may include a grip enhancing material 26 such as a hard foam or soft rubber composition in order to improve the user's grip and reduce the effect of impact.

Attached to the eye 28 of the tether connector 16 is a handle swivel 30. The handle swivel may be any type of connector which has at least two ends and rotates in the middle. In the shown embodiment, the handle swivel 30 has a first ring 32 which is adapted to be able to be opened to attach to another element which, in this case, is the tether connector 16. The adaption to be able to open the ring could be a clip or an overlapping metal ring of the type used on many key rings where a portion of the ring may be separated in order to be slid through another connector. The first ring 32 attaches to a central section 34 which in one embodiment may house a ball bearing swivel assembly. A second ring 36 which may also be opened in a manner similar to the first ring is attached on the other end of the central section 34. It should be appreciated that there are innumerable types of swivels which can be used to accomplish this purpose. One swivel which is suitable is manufactured by Stamina Quality Components of Brooklyn Park, Minnesota, and sold as a ball bearing swivel.

The first end 38 of the tether 40 is attached to the second ring 36 and thus the tether is rotationally attached to the handle. The tether may be unitary or made of a plurality of segments. In addition, each segment may be removably attached to other segments and the segments may be of various materials with different characteristics to provide certain benefits in the use of the training device.

As shown in FIG. 1, the tether 40 may have a first segment 42 and a second segment 44. In one embodiment the first segment is made of an elastic material or a spring and the second segment is made of a chain material. Where the first segment is elastic, the chain of the second segment 44 will have a greater weight than the elastic material 42.

Between the first segment 42 and the second segment 44 is a first swivel connector 46. This swivel connector is located along the tether between segments. It should be appreciated that the length of the segments may be varied in order to achieve various effects. The first swivel connector 46 may be similar to the handle swivel 30 as explained above. At the end of the second segment 44, which in this embodiment is a chain, is a second connector 48. The second connector 48 may be of the same configuration as the first swivel connector 46 and the handle swivel 30. Attached to the second swivel connector 48 is a target attachment 50. The target attachment 50 has a loop 52 for securing to the second swivel connector 48. The opposite end of the target attachment 50 is secured within the target 54 by any one of a number of means well known in the art. In one embodiment, as shown in FIG. 1, the target is a ball.

Figure 2:
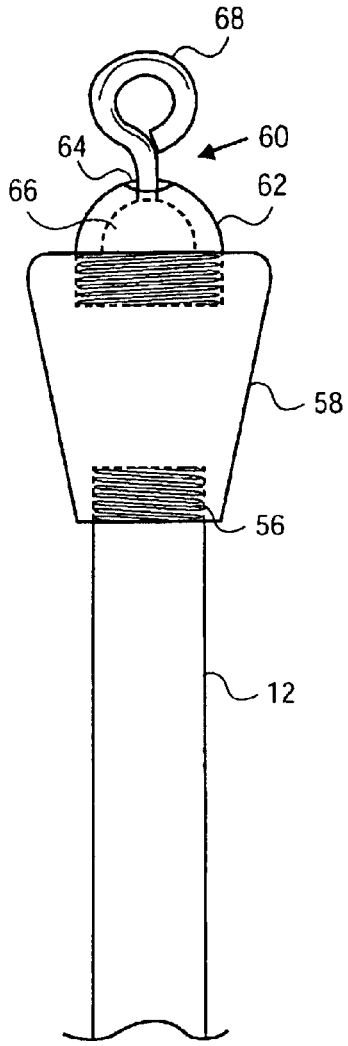
FIG. 2 is a side elevational view of the handle according to an embodiment of this invention.
Figure 3A:
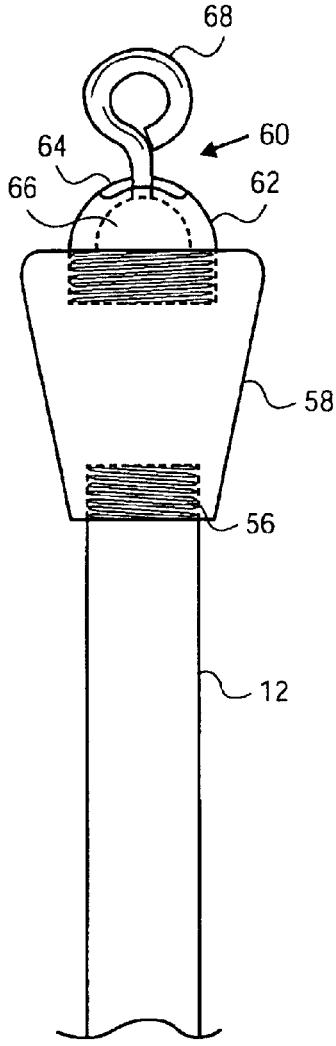
FIG. 3A is a side elevational view of an alternate embodiment of the present invention.
Figure 3B:
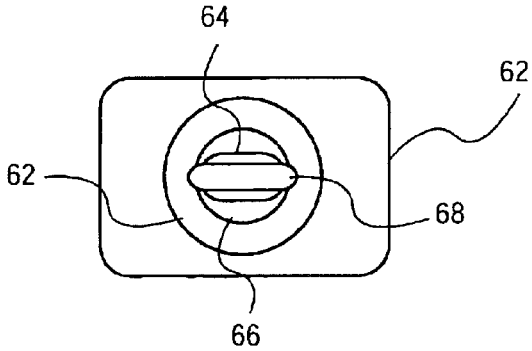
FIG. 3B is a top plan view of the embodiment shown in FIG. 3A.

FIG. 2 shows another embodiment where the handle 12 has threads 56 at one end which engage an internally threaded coupler 58. The top end of the coupler is internally threaded and can mate with an externally threaded swivel 60 which consists of a dome 62 and an aperture 64 at the top of the dome. Within the dome 62 is a stopper 66 which has a hook 68 which extends from the stopper out of the dome aperture 64. The dome aperture may be of any desired configuration including oval, oblong as shown in FIGS. 3A and 3B, or any other configuration that would allow the hook 68 to rotate about the inner periphery of the aperture. The configuration of the dome aperture 64 will affect the rotation of the hook 68 to which a handle swivel 30 would be attached which in turn affects the movement of the target 54.

Figure 4A:
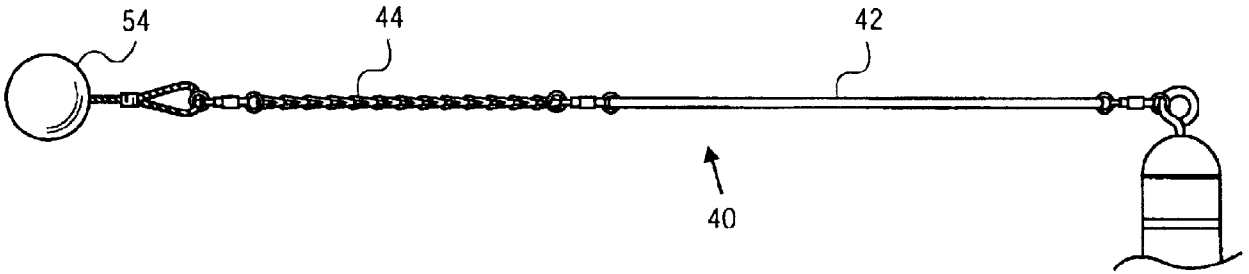
FIG. 4A is a side elevational view of a portion of an embodiment of the invention showing the tether in its quiescent state.
Figure 4B:
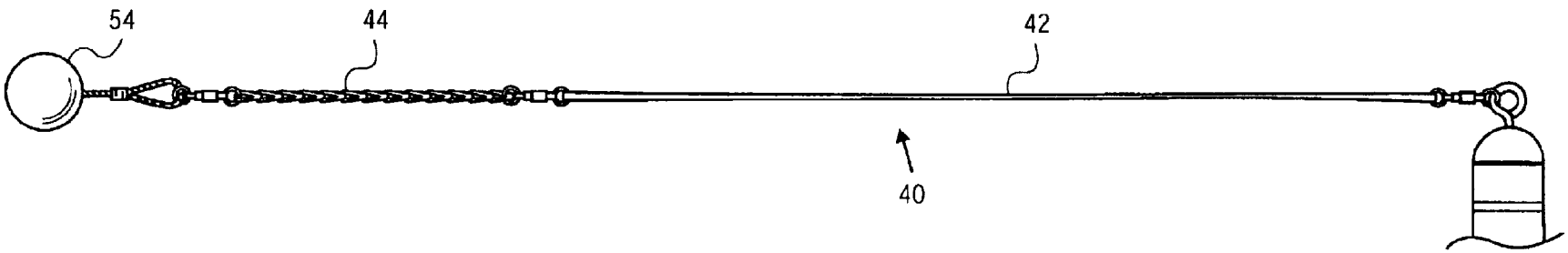
FIG. 4B is a side elevational view of a portion of an embodiment of this invention showing the tether in its extended state.

FIG. 4A discloses an embodiment of the invention where the first segment 42 of the tether 40 is elastic and is in its quiescent state. FIG. 4B discloses the first segment 42 in its extended state which occurs during rotation of the target 54. It should be appreciated that various materials can be used for the segments. For example, either the first segment 42 or the second segment 44 could be made of a wire so as to inhibit twisting. This wire could be bare or coated depending on the preferability of the user. In those situations where the second segment 44 is heavier than the first segment 42, the user will have greater ease in beginning the rotation of the target 54 since there will be more weight at the end of the tether toward the target. Where a chain is being used for one of the segments as shown at 44, in one embodiment the chain is designed to inhibit twisting by having the links connect to each other at flat segments 45.

Figure 5A:
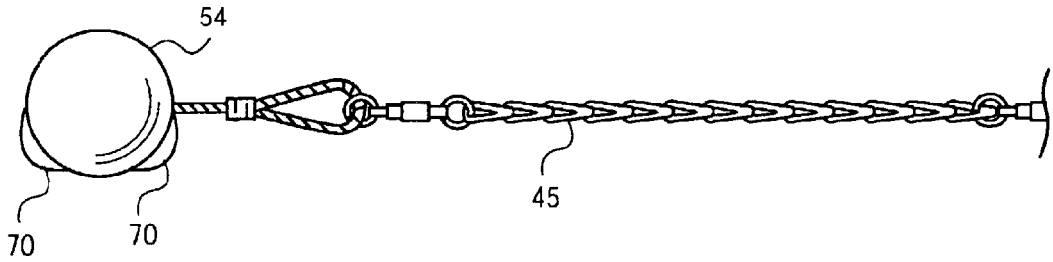
FIGS. 5A–5H show various target configurations of the present invention.
Figure 5B:
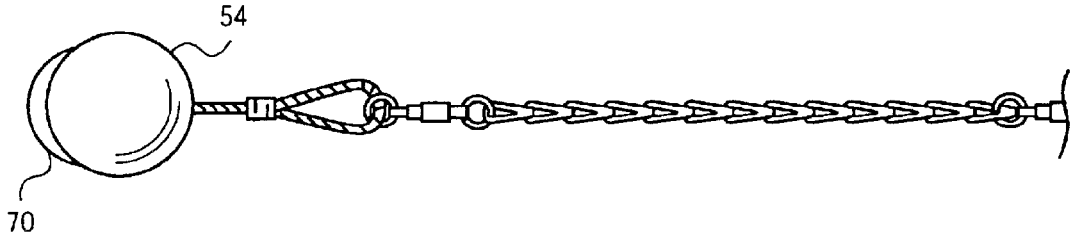
Figure 5C:
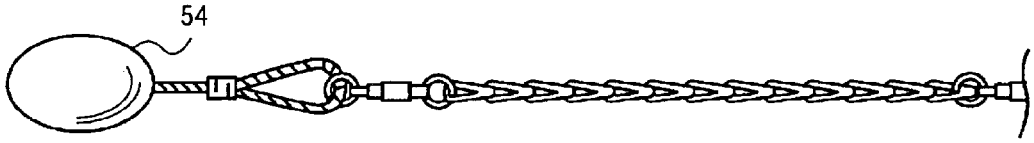
Figure 5D:
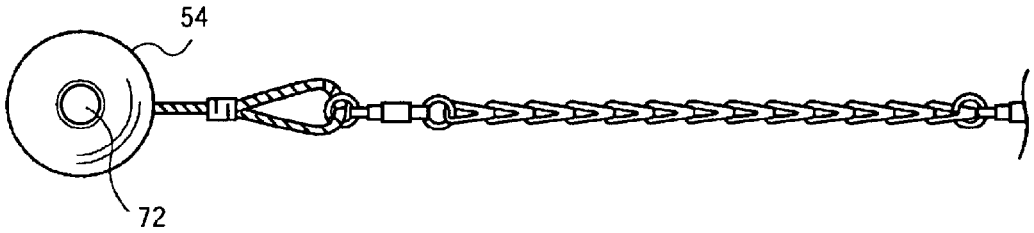
Figure 5E:
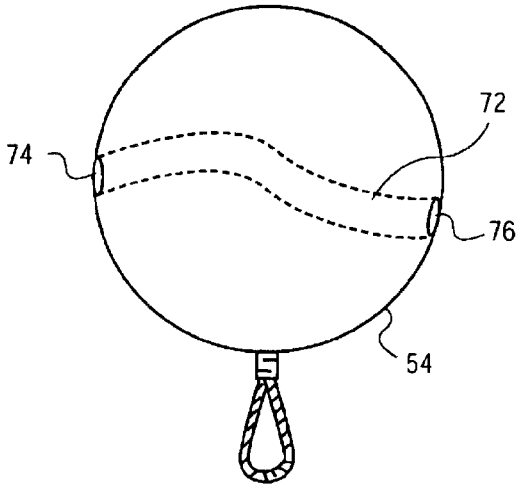
Figure 5F:
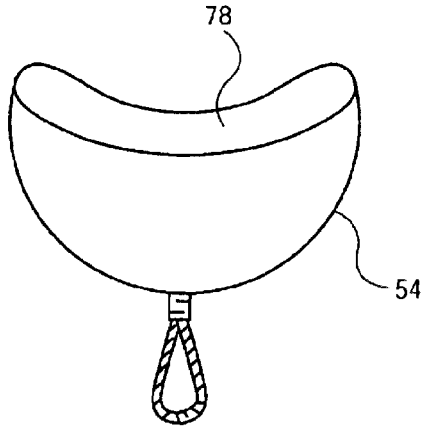
Figure 5G:
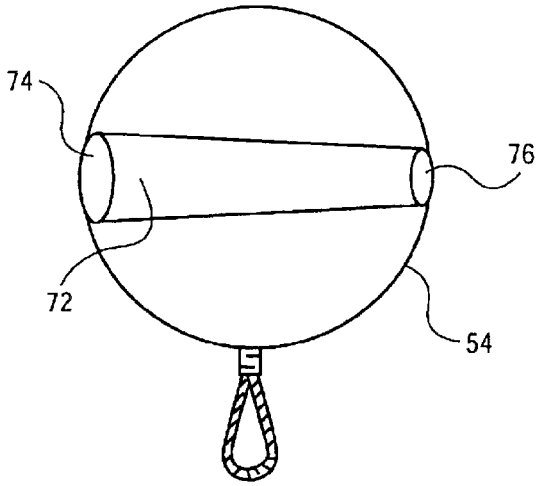
Figure 5H:
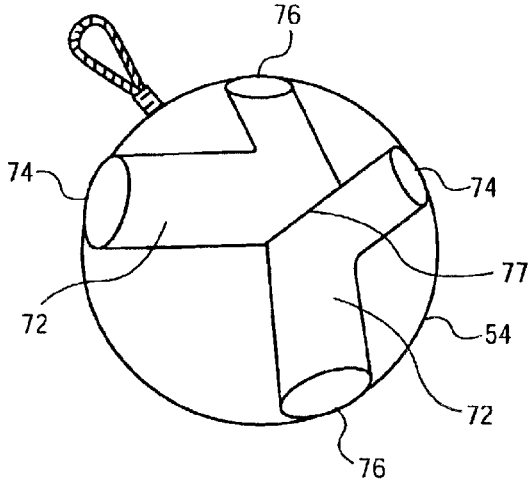

FIGS. 5A through 5H disclose various configurations for the target 54. In FIG. 5A, the target 54 is a ball which includes a pair of airflow diverters 70. The diverters tend to cause the target to turn which will create more target movement during rotation by the user. In FIG. 5B, the target 54 has a single airflow diverter 70. In this configuration the diverter 70 is placed substantially opposite the target attachment 50 which creates more of a flutter type movement during rotation. It should be appreciated that an angling of the airflow diverters 70 will affect the rotation of the ball and thus its movement while it is being spun in a substantially circular pathway. FIG. 5C discloses a target 54 that is spheroid in configuration. FIG. 5D discloses a target 54 having an airflow diverter which is formed as an airflow passageway 72 through the target 54. It should be appreciated that the airflow passageway can extend directly through the target or can be non-linear to provide different ball movements during rotation. For example, as shown in FIG. 5E, the airflow passageway 72 could have a sinusoidal pathway through the target 54. In FIG. 5G, the airflow passageway 72 could have a larger inlet 74 and a smaller outlet 76. It should be appreciated that as the target turns the inlets and outlets may switch and thus the specifyng of particular inlets and outlets is for illustrative purposes only. FIG. 5H shows a target 54 with a plurality of airflow passageways 72. As shown in 5H, the inlets and outlets do not go straight through the ball but are at an angle so that air entering through an inlet on one side will travel out an adjacent side of the target with the air flow pathway angling at about 60° to 120° and cause a different type of target movement. The inlets and outlets as shown in FIG. 5H could be the same or different size from each other or any combination there of. Also, the target could be made without wall 77.

FIG. 5F shows an embodiment wherein the target has a concave surface 78. The size and depth of the concave portion is selected depending upon the type of movement desired. While numerous embodiments of various target configurations have been shown, it should be appreciated that variations in a standard spherical ball can be adapted to create certain movements which will enable a person attempting to contact the target to develop quicker reflexes and better eye-hand coordination.

Figure 6:
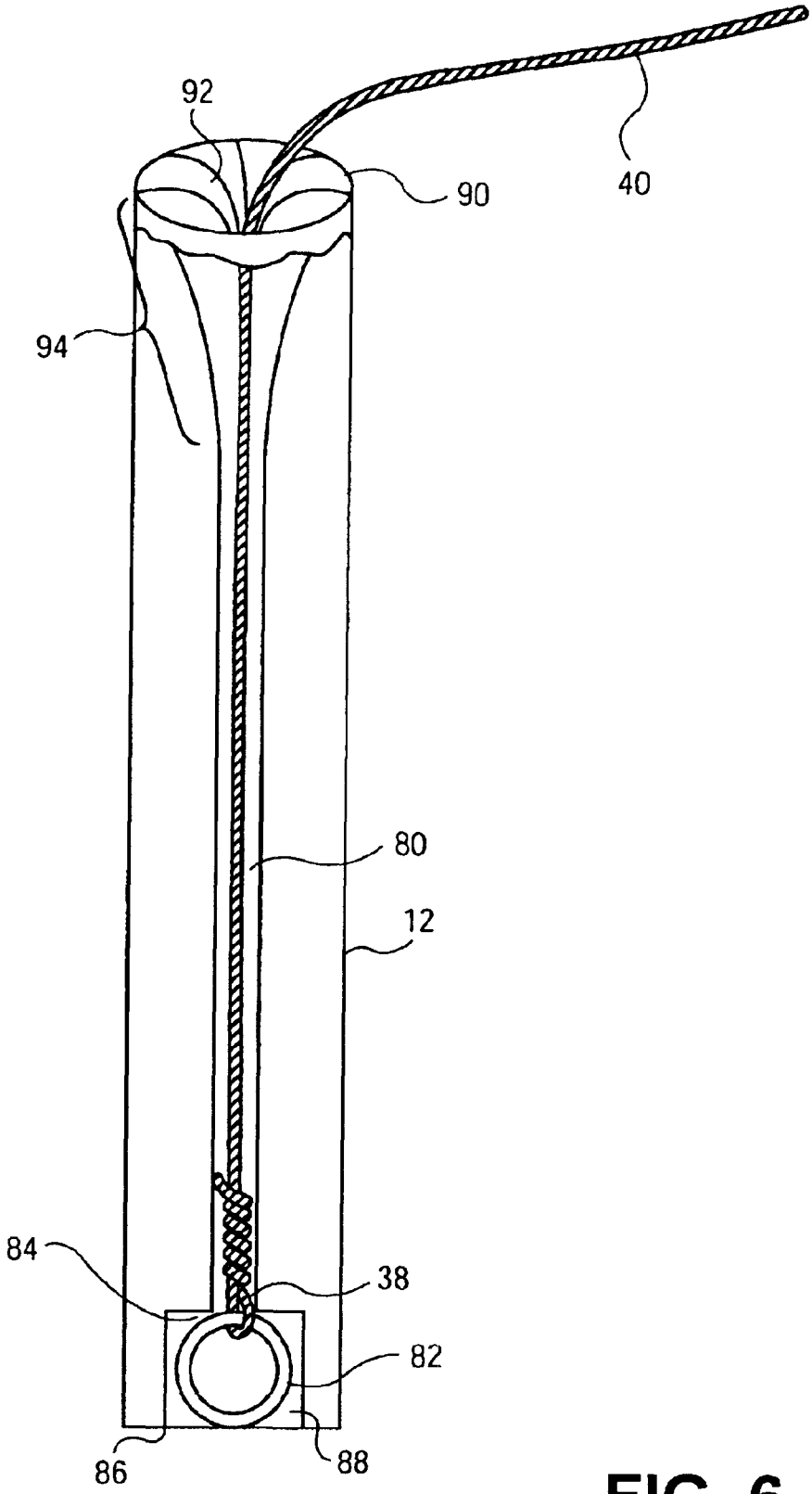
FIG. 6 is a partial cross sectional view of an alternate embodiment of the invention.

FIG. 6 discloses an alternate embodiment wherein the handle 12 is elongate and has a central passageway 80 through which the tether 40 may be passed. In this embodiment the first end 38 of the tether 40 is attached to a rotatable anchor 82. The rotatable anchor is shown in the figure as a ring but it should be appreciated that any configuration which could be attached to the first end 38 and be large enough so as to not pass through the central passageway 80 could be sufficient. For example, but not by way of limitation, the rotatable anchor could be another target, such as a ball, which would be attachable and detachable to the tether. It should be appreciated that as the tether rotates the anchor will also rotate and therefore it is preferable for the anchor to have a smooth outer surface which will facilitate its rotation at the bottom opening 84 of the central passageway 80. In this embodiment, the bottom portion 86 of the handle 12 has a recess 88 which is large enough to receive the rotatable anchor 82 and is larger than the central passageway 80, which is sized so as to be smaller than the rotatable anchor. It should be appreciated that the first end 38 of the tether 40 may be tied to the anchor as shown or could be fashioned with a clip-like attachment to allow it to be easily attached or detached to the rotatable anchor. It is expected that the central passageway will be generally circular in configuration and will have a diameter of approximately one-quarter inch to one-half inch. Comparatively, it is expected that the diameter of the handle will be approximately one inch to one and one-quarter inches. The top opening 90 of the central passageway 80 is flared so as to allow easy rotation of the tether 40 about the inner surface 92 of the flared segment 94. In a possible modification to this alternate embodiment, it should be appreciated that the bottom opening 84 of the central passageway 80 could also be flared as is the top portion. When this modification is combined with the rotatable anchor also being a target, one would have the opportunity of drawing the tether 40 through the handle 12 in order to select which target is to be used. It should also be appreciated that the embodiment shown in FIG. 6 could also be used with the various tether segments and targets disclosed herein.

In operation a user would select desired segments such as 42 and 44 to form the tether 40. The first segment would be attached to a handle swivel 30 and then the second segment 44 would be attached to the first segment 42 by means of a first swivel connector 46. The user would then select a target depending on the type of motion desired and would then attach the loop 52 of the target attachment 50 to a second swivel connector 48 which is attached to the second segment 44. Where the second segment which is closer to the target 54 has a greater weight than the first segment the user, holding the handle 12, will more easily be able to begin the rotation of the target in a relatively circular path. Once this is accomplished, a hitter who will normally have some type of a tool such as a tennis racquet, racquet ball racquet, bat or the like, will take position to hit the target as it travels along its pathway. Once again the selection of the segments and the ball configuration as well as the design of the dome aperture 64 and the length of the handle 12 will all cause certain variations in the movement of the target. The person in training will then seek to hit the target and when successful, the impact can be absorbed by any portion of the tether or has spring which is elastic and also by the grip enhancing material 26 which is on the handle 20. The user then begins rotation of the target again and the practice continues.

The embodiments and examples set forth herein were presented in order to best explain the present invention and its practical application and to thereby enable those of ordinary skill in the art to make and use the invention. However, those of ordinary skill in the art will recognize that the foregoing description aid examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A training device for sports that requires hitting a moving object comprising:

a handle having a central passageway therethrough;

a tether having a first end rotationally attached to the handle by an anchor rotatably engaging the handle, the tether having a second end attached to a target, said tether being slidably positioned in the central passageway;

a first swivel located along the length of the tether whereby said tether can unwind while the target is swung around in a substantially circular pathway; and a second swivel, one of said swivels located toward the end of the tether attached to the handle, and the other swivel located in an intermediate position between two of a plurality of segments of the tether.

2. The invention of claim 1, wherein one of the segments is proximal to the target, said segment proximal to said target having a greater weight than any other tether segment.

3. The invention of claim 2 wherein the segment of greater weight further comprises a chain.

4. The invention of claim 1 further comprising a plurality of segments removably attached to each other, wherein one of the tether segments is expandable so as to expand and contract between a quiescent and extended state.

5. The invention of claim 4 wherein the expandable segment is elastic.

6. The invention of claim 4 wherein the expandable segment includes a spring.

7. The invention of claim 1 further comprising a plurality of segments removably attached to each other, wherein at least one tether segment is a wire.

8. The training device of claim 1, wherein the anchor comprises a ring attached to the first end of the tether.

9. The training device of claim 1, wherein the central passageway has a flared opening toward at least one end of the handle.

10. A training device for sports that require hitting a moving object comprising:

a handle;

a tether having a first end rotationally attached to the handle and a second end attached to a target;

at least one air flow diverter unitary with the target and not providing an attachment point for the tether, the air flow diverter being for altering the path of the target as the target is swung in a substantially circular pathway;

said air flow diverter is at least one air hole; and said air hole extends through the target, said air hole has an inlet opening and an outlet opening, said-openings being different sizes.

11. The invention of claim 10 where the target is substantially spheroid.

12. The invention of claim 10 wherein the target is oblong.

13. The invention of claim 10 wherein the flow diverter comprises ridges on the target.

14. The invention of claim 10 wherein the air diverter is at least one air hole; and the at least one air hole is provided by structure in the target that is elongate in a direction adapted for air flow.

15. The invention of claim 10 wherein the air hole extends into the target and turns at an angle of from about 60° to 120°.

16. The training device of claim 10, wherein:

the target has an outer surface; and the air flow diverter guides air through the outer surface.

17. A training device for sports that requires hitting a moving object:

a handle;

a handle swivel removably attached to the handle, the swivel further comprises a cap having an opening, said opening defining a pathway about a periphery of the opening;

a tether having a first end removably attached to the swivel and a second end attached to a target; and a tether connector having:

a first end moveably captured within the cap;

an extension having a base secured to the first end and extending through the opening; and a top forming an eye for securing the tether;

wherein rotation of the tether causes the extension to rest upon and travel along the periphery of the opening.

18. The invention of claim 17 wherein the periphery is substantially spherical.

19. The invention of claim 17 wherein the periphery is non-spherical.

20. A training device for sports that requires hitting a moving object comprising:

a handle;

a composite tether having a first end rotationally attached to the handle and a second end attached to a target, said composite tether having a plurality of segments removably attached to each other, said plurality of segments comprising a respective plurality of disparate materials in the segments;

a first swivel connector located along the length of the tether whereby said tether can unwind while the target is swung around in a substantially circular pathway; and the plurality of segments comprise a segment comprising an elastic material, and a segment comprising a metal chain.

* * * * *